US009239168B2

(12) United States Patent
Brunner et al.

(10) Patent No.: US 9,239,168 B2
(45) Date of Patent: Jan. 19, 2016

(54) TELESCOPIC RAIL DEVICE AND MUFFLE COMPRISING SAID TELESCOPIC RAIL DEVICE

(75) Inventors: Martin Brunner, Pforzheim (DE); Jochen Herbolsheimer, Trostberg (DE); Manfred Hintermayer, Karlsruhe (DE)

(73) Assignee: BSH Hausgeraete GmbH, Munich (DE)

( * ) Notice: Subject to any disclaimer, the term of this patent is extended or adjusted under 35 U.S.C. 154(b) by 432 days.

(21) Appl. No.: 13/255,934

(22) PCT Filed: Aug. 10, 2009

(86) PCT No.: PCT/EP2009/060338
§ 371 (c)(1),
(2), (4) Date: Sep. 15, 2011

(87) PCT Pub. No.: WO2010/102679
PCT Pub. Date: Sep. 16, 2010

(65) Prior Publication Data

US 2011/0317946 A1 Dec. 29, 2011

(30) Foreign Application Priority Data

Mar. 13, 2009 (DE) ..... 10 2009 001 550

(51) Int. Cl.
*F16C 29/02* (2006.01)
*F24C 15/16* (2006.01)
*A47B 88/04* (2006.01)

(52) U.S. Cl.
CPC ..... *F24C 15/168* (2013.01); *A47B 88/04* (2013.01)

(58) Field of Classification Search
CPC ..... F25C 15/16; F25C 15/168; A47B 88/044; A47B 88/047; A47B 2088/0448; A47B 2088/0459; A47B 2210/0018; A47B 2210/0024; A47B 2210/0081; A47B 2210/0094
USPC ..... 312/334.1, 334.7, 334.8, 333, 334.44, 312/410; 384/18, 21, 22; 126/339, 333
See application file for complete search history.

(56) References Cited

U.S. PATENT DOCUMENTS

| | | | | |
|---|---|---|---|---|
| 7,244,005 | B1 * | 7/2007 | Lu | 312/333 |
| 7,458,651 | B1 * | 12/2008 | Radke et al. | 312/333 |
| 2003/0127957 | A1 * | 7/2003 | Lin | 312/333 |
| 2004/0112371 | A1 * | 6/2004 | Le et al. | 126/334 |
| 2004/0174101 | A1 * | 9/2004 | Lin | 312/333 |

(Continued)

FOREIGN PATENT DOCUMENTS

| | | |
|---|---|---|
| DE | 7206516 U | 5/1972 |
| DE | 20006921 U1 | 8/2000 |

(Continued)

OTHER PUBLICATIONS

Report of Examination EP 09 781 668.0 dated Apr. 12, 2013.

(Continued)

*Primary Examiner* — Daniel J Troy
*Assistant Examiner* — Ryan A Doyle
(74) *Attorney, Agent, or Firm* — James E. Howard; Andre Pallapies

(57) ABSTRACT

A telescopic rail device is provided that includes a first rail, a second rail, and an adapter. The first rail is mobile relative to the second rail, and the first or second rail is detachably connected to the adapter. The adapter is in a stable position relative to the first or second rail that the adapter is detachably connected to.

19 Claims, 2 Drawing Sheets

(56) References Cited

U.S. PATENT DOCUMENTS

| | | | | |
|---|---|---|---|---|
| 2004/0245898 | A1* | 12/2004 | Amann et al. | 312/334.46 |
| 2005/0074190 | A1* | 4/2005 | Traiser et al. | 384/21 |
| 2005/0217658 | A1 | 10/2005 | Sozo et al. | |
| 2006/0279186 | A1* | 12/2006 | Lam et al. | 312/319.1 |
| 2008/0247812 | A1* | 10/2008 | Embacher | 403/231 |
| 2008/0265730 | A1* | 10/2008 | Huang | 312/333 |
| 2009/0016812 | A1* | 1/2009 | Wittgrebe | 403/189 |
| 2009/0079313 | A1* | 3/2009 | Brunner et al. | 312/334.32 |
| 2009/0121595 | A1* | 5/2009 | Yang | 312/334.1 |
| 2009/0140621 | A1* | 6/2009 | Yang | 312/319.1 |
| 2009/0293857 | A1* | 12/2009 | Segers | 126/19 R |
| 2012/0090594 | A1* | 4/2012 | Rehage et al. | 126/339 |

FOREIGN PATENT DOCUMENTS

| | | | | |
|---|---|---|---|---|
| EP | 1376018 | A1 | 1/2004 | |
| EP | 1502521 | A1 * | 2/2005 | A47B 88/08 |
| GB | 2426694 | A | 12/2005 | |
| WO | 2005003636 | A1 | 1/2005 | |
| WO | WO 2007000357 | A1 * | 1/2007 | |
| WO | WO 2007074114 | A1 * | 7/2007 | A47B 88/04 |

OTHER PUBLICATIONS

International Search Report PCT/EP2009/060338.
National Search Report DE 10 2009 001 550.7.
Granting Decision RU 2011139578 dated Nov. 27, 2013.

* cited by examiner

TELESCOPIC RAIL DEVICE AND MUFFLE COMPRISING SAID TELESCOPIC RAIL DEVICE

BACKGROUND OF THE INVENTION

The invention relates to a telescopic rail device having at least one first rail which is mobile relative to a second rail of the telescopic rail device. Furthermore, the invention relates to a muffle for a domestic appliance for preparing food with a telescopic rail device of this type.

Telescopic rail devices in the case of domestic appliances for preparing food, such as for instance ovens or steam cookers, are known. A grill pan, a baking tray or a grating can be positioned on these telescopic rail devices for instance and slid into or pulled out of the cooking compartment. Furthermore, ovens are also known in which an oven carriage is provided which can be slid in and out in the horizontal direction using a telescopic rail device and the door integrated in the oven carriage is arranged so as to close the cooking compartment.

On account of the difference between domestic appliances, a plurality of different telescopic rail devices is known. These often have to be adjusted structurally to the specific conditions at their place of installation. A plurality of different telescopic rail devices is therefore present. This requires significant construction effort and the provision of several different telescopic rail devices is also very cost-intensive.

BRIEF SUMMARY OF THE INVENTION

It is the object of the present invention to create a telescopic rail device, which can be used in a more flexible fashion for different applications and is embodied so as to be highly functional. Furthermore, a muffle is to be created for a domestic appliance for preparing foods, which can be embodied in a more variable fashion and can be changed in terms of function.

These objects are achieved by a telescopic rail device which comprises the features as claimed in claim 16, and by a muffle which comprises the features as claimed in claim 30.

An inventive telescopic rail device includes a first rail and at least a second rail. The two rails are mobile relative to one another. At least one rail is embodied for a detachable connection to an adapter and the adapter is arranged in a stable position relative to this rail when connected to the rail. This means that in the final state connected to one another, there is no longer any relative mobility between the adapter and the rail, to which the adapter is fastened. This adapter and the specific design of a rail enable the embodiment of the telescopic rail device to also be changed and adjusted in various ways after its manufacture. As a result it is possible for the first and the second rail essentially to be embodied similarly in the case of a plurality of embodiments and the individualization and specialization of the telescopic rail device is created overall by the adapter. A telescopic rail device of this type therefore enables the complex construction of a plurality of different telescopic rail devices to be avoided and as a result costs are also saved. Also in case of manufacture and assembly, both effort and also time can therefore be reduced, as a result of which costs can in turn be saved. A uniform interface thus enables a standard telescopic rail device to be provided with the two rails, which can be extended at any time by additional individual features by the specific adapter. The basic production process of the standard rail in the form of the first and the at least second rail of the telescopic rail device may therefore proceed in a standardized and similar fashion for a plurality of telescopic rail devices. This adapter enables a variant generation of the telescopic rail device at a very late point in time in the production chain. One particular advantage is that the telescopic rail device can be changed at various points in time and in various situations by attaching or removing a specific adapter.

Thus for example a user of the telescopic rail device or service engineer can convert or retrofit the telescopic rail at a later date. Furthermore, it is possible for a user also to be able to individually change the telescopic rail device even years after purchase and thus be able to expand said device for new applications or with additional properties and functions.

The detachable connection option of the adapter with a rail is particularly advantageous. This embodiment in the form of a non-destructive, detachable and reattachable embodiment of the adapter allows for replacement for assembly purposes, maintenance work or for replacement after wear. In this context, the entire system no longer has to be dismantled or replaced, but instead only this adapter. This also saves time, costs etc. In particular, this reversibly detachable attachment of the adapter can also functionally change or adjust the telescopic rail device in any arbitrary fashion.

The rail which is embodied to connect to the adapter is preferably embodied shorter than the other rail. The individual extendibility by means of different adapters is herewith ensured and the assembly of the rail on an object can be simplified when connected to the adapter.

In particular, provision is made for the rail to which the adapter can be attached to be designed such that different adapters can also be attached to the mounting point. This means that the mounting point on the rail is compatible for different adapters, so that as a result of the, if necessary, also standardized mounting point, a rapid and uncomplicated replacement of adapters is ensured in a simple and uncomplicated fashion. The functionality and specification of a telescopic rail device and the modification or extension of the telescopic rail device can be increased again by attaching different adapters to the rail. Furthermore, this can then also be done very easily and with minimal effort.

A rail of the telescopic rail device is preferably embodied at its free end with a holding fixture, which is embodied so as to attach the adapter. A position is created on the rail by attaching the adapter to a free end, whereby the accessibility is particularly suitable and a particularly favorable position in respect of the individualization of the telescopic rail device and the extension of the functionality is furthermore also provided.

The telescopic rail device can preferably be attached to a wall of an object, and the adapter of the telescopic rail device can be attached to the rail, which is provided on this wall of the object for fastening purposes. In this embodiment, the adapter is thus attached to the rail, which is fastened to the wall. The other rail, on which the adapter is not arranged, is then provided for relative mobility with respect to the fastened rail and for pulling out and sliding therein.

It is precisely this attachment of the adapter which allows for the individual design of the telescopic rail device with respect to fastening and/or further functionalities for the user-friendly movement of the mobile rail and suchlike.

The adapter is preferably embodied to be elongated and extends, when connected to the rail, in the extension of the rail. In particular, the adapter then extends in the direction of the longitudinal axis of the rail on which it is arranged. The adapter can therefore be used at least as an extension and thus individual length embodiment of the rail on which it is arranged. Also in this respect, telescopic rail devices can therefore also be formed variably, which are embodied at least in respect of the length of the rail which can be fastened to a wall of an object.

The adapter is however preferably embodied in a multifunctional fashion. This embodiment enables the functionality range of the telescopic rail device to be extended repeatedly by means of an additional part of the telescopic rail device. A plurality of further components is therefore no longer needed for the telescopic rail device, but the multifunctionality can instead merely be ensured by this one part. A multifunctional embodiment of a part of this type, namely the adapter, can, in case of need, also reduce the assembly time, since only one part has to be attached or removed and not a plurality of parts of this type. In particular, the number of components of the telescopic rail device can therefore also be restricted, thereby also resulting in a weight saving.

In particular, provision is made for the multifunctionality of the adapter to be especially provided so that the adapter is preferably embodied so as to lengthen the rail, to which it is attached and/or additionally for a damping facility for damping the movement of the other mobile rail and/or for a facility for the automatic feed of the mobile rail and/or for a facility for the latching positioning of the mobile rail and/or a retaining facility for fastening the rail, to which it is attached. The functionality range can therefore be extended with respect to reducing wear, user-friendliness and ease of operation, with, to this end, preferably only the one part being needed in the form of the adapter.

The adapter and the rail to which it is to be attached can preferably be connected by means of a plug-in connection. This is a connection which is particularly simple to construct but is nevertheless stable and can also be detached and attached in a quick and easy fashion. Furthermore, this type of connection is low-wear and robust.

The rail to which the adapter can be attached is preferably embodied hollow at least in regions and this hollow body formation is embodied so as to receive the adapter. As a result, the stable connection can also be suitably improved.

The rail preferably comprises recesses on the side walls, said recesses being embodied so as to receive plug-in elements, which are arranged on the end of the adapter which faces the rail.

In particular, the plug-in elements of the adapter are embodied from hook-shaped locking elements. The plug-in connection can therefore be embodied in particular as a locking connection with, in the connected state, a particularly position-fixing and self-adhering connection then being created.

The plug-in elements are preferably at least partially mobile, in particular elastically spring-loaded, so that insertion into the recesses of the side walls and also removal therefrom can be repeatedly carried out easily and still without wear or damage.

A base body of the adapter is preferably adjusted to the shape of the rail to which it can be attached. This means in particular that the cross sections of the rail and of the adapter are the same at least in the connecting region, in particular essentially across the whole length of the rail and the adapter. By means of this embodiment, in addition to improving the function, the installation space can also be kept as small as possible. Furthermore, an embodiment of this type can as it were also produce a constant transition to the connecting point, which, in addition to technical improvements, also gives an impression of high quality and if necessary, the adapter is as such no longer perceived as a separate part.

The adapter is preferably embodied such that it extends the length of the rail to which it is attached, essentially to the length of another rail.

The adapter can preferably be attached to the rear end of the other rail which faces towards the pulling direction of a rail. This means that in the completely pushed-together state, the adapter is as it were attached to the rear end of the telescopic rail device and when the other rail, which is mobile relative to the rail on which the adapter is arranged, is pulled out, points theretowards. The pulling direction and thus the direction when pulling out the mobile rail is therefore almost directed at this end, on which the adapter on the rail comprising the adapter is arranged.

The telescopic rail device may only comprise two rails, one of which is fastened to a wall and is referred to as a fixed rail, and a rail which is mobile relative thereto, which is referred to as a loose rail. In particular, the fixed rail is embodied for connection with the adapter. Provision can also be made for the telescopic rail device to comprise more than two rails, with a fixed rail and several loose rails then being provided, which are mobile relative to one another and relative to the fixed rail, and can in particular be pulled out.

An inventive muffle for a domestic appliance for preparing food includes an inventive telescopic rail device or an advantageous embodiment thereof, with this telescopic rail device being arranged on a wall of the muffle. The domestic appliance may be an oven or a steam cooker for instance. This embodiment of the muffle considerably increases its functionality, since the change in the telescopic rail device can also change its functionality. Other objects can therefore if necessary also be introduced into the muffle by way of the telescopic rail device or further functionalities can also be produced.

Further features of the invention emerge from the claims, the figures and the description of the figures. The features and feature combinations cited above in the description as well as the features and feature combinations cited below in the description of the figures and/or shown alone in the figures can be used not only in the respectively cited combination, but also in other combinations or on their own, without departing from the scope of the invention.

BRIEF DESCRIPTION OF THE DRAWINGS

An exemplary embodiment is explained in more detail below with the aid of schematic drawings, in which.

DETAILED DESCRIPTION OF EXEMPLARY EMBODIMENTS OF THE PRESENT INVENTION

Figure 1:
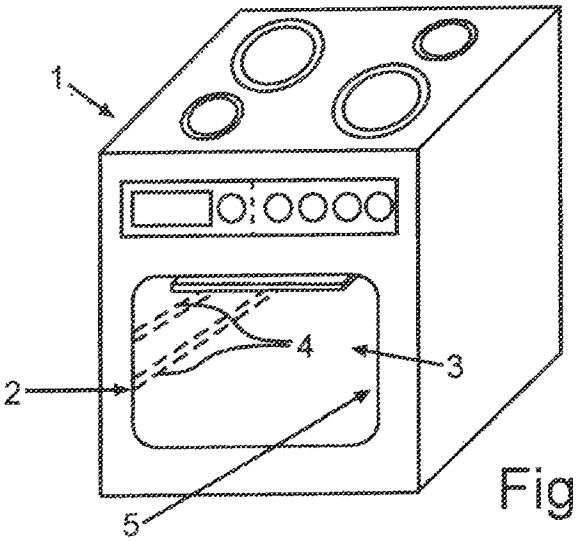
FIG. 1 shows a schematic perspective diagram of an oven with a telescopic rail device.

The same or functionally similar elements are provided with the same reference characters in the figures.

FIG. 1 shows a schematic perspective diagram of a domestic appliance embodied as an oven 1 for preparing food. The oven 1 includes a muffle 2, which opens at the front and can be closed by means of a door of the oven 1 (not shown in further detail). The muffle 2 forms a cooking compartment 3 in the interior, in which food can be prepared. Telescopic rail devices 4 and 5 are arranged on the opposing vertical side walls in each instance on the inner walls of the muffle 2. Preparation containers such as a grill pan, a baking tray, a grid or suchlike, can be positioned on these telescopic rail devices 4 and 5, which, by pairs, also define different shelf levels in the cooking compartment 3.

An exemplary embodiment of the telescopic rail device 4 is explained below in more detail. The telescopic rail device 5 is embodied similarly.

Figure 2:
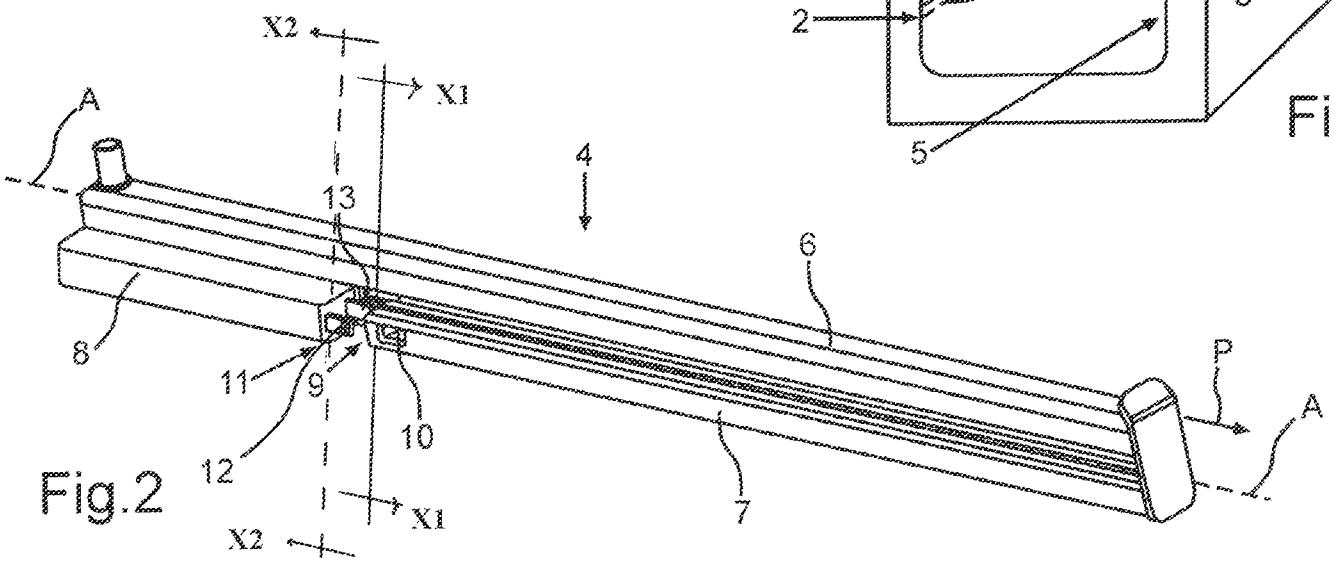
FIG. 2 shows a perspective diagram of an exemplary embodiment of an inventive telescopic rail device.

FIG. 2 also shows a schematic perspective diagram of a telescopic rail device 4. In the exemplary embodiment, this only includes a first rail 6 and a second rail 7. In the embodiment shown, the second rail 7 is arranged fixed on the inner wall of the muffle 2 and the first rail 6 is arranged so as to be freely mobile relative to this second rail 7. The first rail 6 can be moved to and fro in the longitudinal direction and thus in the direction of the longitudinal axis A of the telescopic rail device 4 and is thus moved relatively opposite to the second rail 7. The two rails 6 and 7 are oriented in parallel relative to one another, whereby in the embodiment shown, the first rail 6 is embodied to be longer than the second rail 7.

The telescopic rail device 4 also includes an adapter 8, which can be attached to and removed from the second rail 7 in a non-destructive fashion. In the diagram in FIG. 2, the separate state of the adapter 8 from the second rail 7 is shown. The adapter 8 is embodied as an elongated part, which is embodied multifunctionally in the embodiment shown. This means that on the one hand it is designed to lengthen the second rail 7 and furthermore comprises at least one further function. To this end, provision can be made for the adapter 8 to comprise a damping facility for damping the movement of the mobile rail 6 and/or for a facility for the automatic feed of the mobile rail 6 and/or a facility for the automatic feed of the mobile rail 6 and/or a facility for the latching positioning of the mobile rail 6 at different discrete pulling points and/or a retaining facility for fastening the rail 7.

In the diagram according to FIG. 2, the telescopic rail device 4 is shown in a completely inserted state. Based on this situation which is pushed completely together, the first rail 6 can be pulled out forwards in the direction of arrow P. In respect of this representation in Fig, 2, the adapter 8 can be attached to the rear end 9 of the second rail 7. The second rail 7 is embodied hollow at least at this end 9 and is specifically designed for connection to the adapter 8, so that the adapter 8 can extend at least partially into the rail 7. As shown in the diagram according to FIG. 2, in this hollow region of the second rail 7, the vertical side walls comprise opposing recesses, with only recess 10 being visible in FIG. 2. The adapter 8 comprises two plug-in elements 12 and 13 on its end 11 which faces the end 9 of the second rail 7, said plug-in elements 12 and 13 being embodied in the exemplary embodiment as hook-shaped locking elements. When the adapter 8 is assembled with the second rail 7, these elements 12 and 13 engage into the recesses 10. In the connected state, the adapter 8 thus represents an extension of the second rail 7.

In the exemplary embodiment shown, provision is made for the total length of these two components to correspond approximately to the length of the first rail 6 when the adapter 8 is assembled with the second rail 7. The adapter 8 is matched to the molding of the second rail 7 in respect of its molding. When the two components are assembled, an as it were constant transition to the connecting point is as a result achieved and no additional installation space is needed thereabove or below on account of the same or essentially the same molding. Furthermore, by means of this embodiment, it is also possible to communicate the impression of a one-piece part when the adapter 8 is assembled with the second rail 7.

Figure 3:
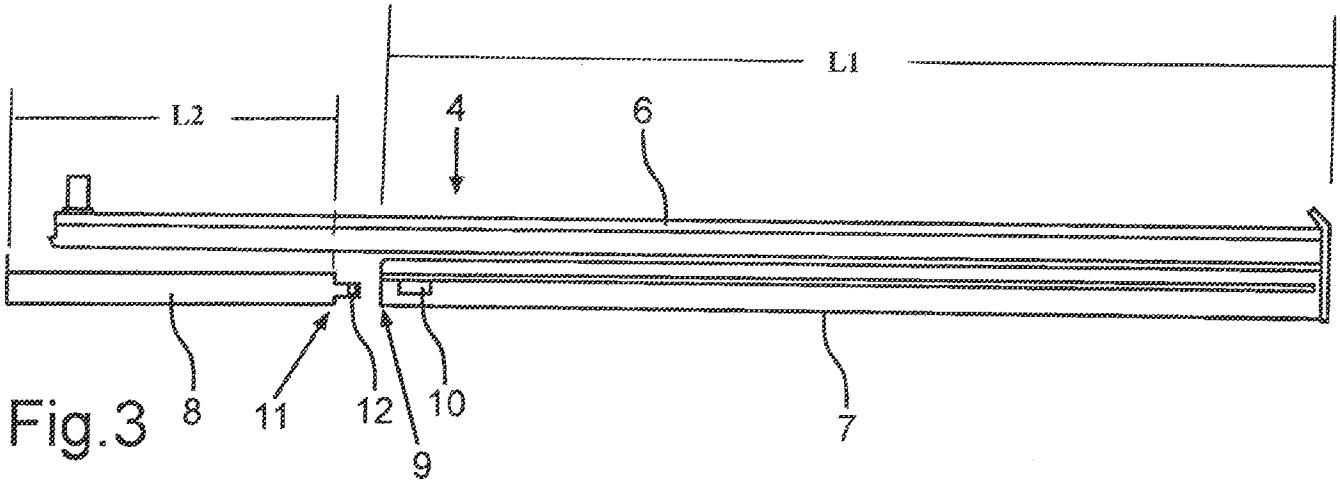
FIG. 3 shows a side view of the telescopic rail device according to FIG. 2.

FIG. 3 shows a side view of the telescopic rail device 4 according to FIG. 2.

Figure 4:
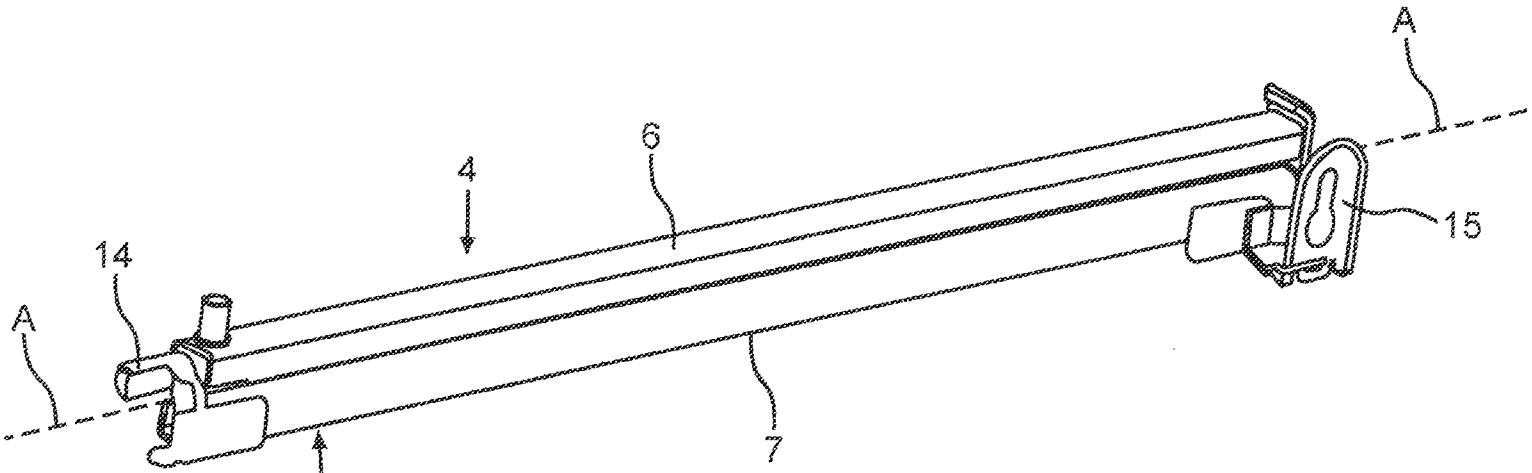
FIG. 4 shows a perspective diagram of a further exemplary embodiment of an inventive telescopic rail device.

FIG. 4 shows a further perspective diagram of an embodiment, in which the adapter 8 is connected to the second rail 7. Furthermore, a retaining element 14 is arranged on the adapter 8, with which the telescopic rail device 4 can be fastened to the inner wall of the muffle 2. A further fastening on the interior of the muffle 2 can take place using a further retaining element 15, which is fastened to the front side and/or to the front end of the second rail 7.

The second rail 7 is lengthened to approximately the length of the first rail 6 by means of the adapter 8.

In the exemplary embodiment shown, provision is made for the total length of these two components to correspond approximately to the length of the first rail 6 when the adapter 8 is assembled with the second rail 7. The adapter 8 is matched to the shape of the second rail 7 in respect of its shaping. With reference to FIG. 2 and FIG. 3, the cross section of the rail, taken through lines Xl-Xl, and the cross section of adapter, taken through lines X2-X2, are the same at least in the connecting region, in particular across the length of the rail Ll and the length of the adapter L2, the respective lengths extending along longitudinal axis A. When the two components are assembled, an as it were constant transition to the connecting point is as a result achieved and no additional installation space is needed thereabove or below on account of the same or essentially the same molding. Furthermore, by means of this embodiment, it is also possible to communicate the impression of a one-piece part when the adapter 8 is assembled with the second rail 7.

Furthermore, a facility for fixing the position of the rail 6 can be arranged on the adapter 8 or in the adapter 8. Certain pulling positions can herewith be fixed and/or stopped.

LIST OF REFERENCE CHARACTERS

1 Oven
2 Muffle
3 Cooking compartment
4, 5 Telescopic rail devices
6, 7 Rails
8 Adapter
9 End of a rail
10 Recess
11 End of the adapter
12, 13 Plug-in elements
14, 15 Retaining elements

The invention claimed is:

1. A telescopic rail device, comprising:

a first rail having a predetermined elongate shape, the first rail including a length extending along a long axis of the first rail;

a second rail having a predetermined elongate shape, the second rail including a length extending along a long axis of the second rail, wherein the first rail is mobile relative to the second rail, and wherein the first rail travels over the second rail; and an adapter having an adapter body with a predetermined elongate shape, the adapter body including a length extending along a long axis of the adapter body;

wherein one of the first and second rails is detachably connected to the adapter at a junction; and wherein a cross section of the adapter body at the junction is the same as a cross section of the one of the first and second rails to which the adapter is detachably connected at the junction and extending throughout the length of the adapter body and the length of the one of the first and second rails to which the adapter is detachably connected for a constant transition from the adapter to the one of the first and second rails to which the adapter is detachably connected for communicating the appearance of a one-piece part.

2. The telescopic rail device of claim 1, wherein the one of the first and second rails that the adapter is detachably connected to is shorter than the other of the first and second rails.

3. The telescopic rail device of claim 1, wherein at least one of the first and second rails comprises a recess for attaching the adapter on a free end of the at least one of the first and second rails.

4. The telescopic rail device of claim 1, wherein the telescopic rail device is attached to a wall of an object and the adapter is attached to one of the first and second rails that is fastened to the wall.

5. The telescopic rail device of claim 1, wherein the adapter is elongated and extends in a longitudinal direction of the one of the first and second rails when the adapter is connected to one of the first and second rails.

6. The telescopic rail device of claim 1, wherein the adapter is configured to perform one or more functions.

7. The telescopic rail device of claim 1, wherein the adapter is embodied to augment the length of the one of the first and second rails to which the adapter is detachably connected, and wherein the adapter comprises at least one of:

a damping facility for damping the movement of the first rail a facility for automatic feeding of the first rail;

a facility for a latching positioning of the first rail; and a retaining facility for fastening the one of the first and second rails to which the adapter is detachably connected.

8. The telescopic rail device of claim 1, wherein the adapter and the one of the first and second rails are detachably connected by means of a plug-in connection.

9. The telescopic rail device of claim 8, wherein the one of the first and second rails is hollow in some areas and embodied to receive the adapter.

10. The telescopic rail device of claim 8, wherein side walls of the one of the first and second rails comprise recesses to receive plug-in elements arranged on an end of the adapter that faces towards the one of the first and second rails.

11. The telescopic rail device of claim 10, wherein the plug-in elements are hook-shaped locking elements.

12. The telescopic rail device of claim 11 wherein the adapter body extends away from the one of the first and second rails to which the adapter is detachably connected with only the hook-shaped locking elements projecting into the one of the first and second rails to which the adapter is detachably connected.

13. The telescopic rail device of claim 1, wherein the length of the adapter and the length of the one of the first and second rails to which the adapter is detachably connected substantially equals the length of the other one of the first and second rails.

14. The telescopic rail device of claim 1, wherein the adapter is detachably attached to an end of the second rail, wherein the first rail travels out of and into a covering relationship with the adapter.

15. A muffle for a domestic appliance for preparing food, the muffle comprising a muffle wall on which a telescopic rail device is arranged that includes:

a first rail having a predetermined elongate shape, the first rail including a length extending along a long axis of the first rail and a vertically oriented side wall;

a second rail having a predetermined elongate shape, the second rail including a length extending along a long axis of the second rail and a vertically oriented side wall, wherein the first rail is mobile relative to the second rail, and wherein the first rail travels over the second rail; and an adapter having an adapter body with a predetermined shape, the adapter body including a length extending along a long axis of the adapter body, a vertically oriented side wall; and at least one hook-shaped locking element projecting away from the adapter body along the long axis of the adapter body;

wherein one of the first and second rails is detachably connected to the adapter at a junction with the at least one hook-shaped locking element operationally engaged with the one of the first and second rails to which the adapter is detachably connected such that the adapter is at least one of parallel to and coincident with the one of the first and second rails, wherein the vertically oriented side walls of the adapter body, first, and second rails are along the long axes of the adapter body, first, and second rails, respectively, and wherein the vertically oriented side wall of the adapter body and the vertically oriented side wall of the one of the first and second rails to which the adapter is detachably connected fit flush at the junction, wherein the vertically oriented vertically oriented side wall of the adapter body and the side wall of the one of the first and second rails to which the adapter is detachably connected are arranged such that a constant transition from the adapter to the one of the first and second rails to which the adapter is detachably connected communicates the appearance of a one-piece part.

16. The muffle of claim 15, wherein the muffle wall extends between a rear muffle wall and an access opening wherein the adapter is detachably connected to an end of the second rail closer to the rear muffle wall than the access opening.

17. The muffle of claim 15 wherein the adapter body extends away from the one of the first and second rails detachably connected to the adapter with only the at least one of the hook-shaped locking elements projecting into the one of the first and second rails detachably connected to the adapter.

18. The muffle of claim 17 wherein the side wall of the one of the first and second rails to which the adapter is detachably connected includes a recess for receipt of a respective one of the hook-shaped locking elements for detachably connecting the adapter to one of the first and second rails while maintaining the appearance of a one-piece part.

19. A muffle for a domestic appliance for preparing food, the muffle comprising a muffle wall on which a telescopic rail device is arranged that includes:

a first rail having a predetermined elongate shape, the first rail including a length extending along a long axis of the first rail;

a second rail having a predetermined elongate shape, the second rail including a length extending along a long axis of the second rail, wherein the first rail is mobile relative to the second rail, and wherein the first rail travels over the second rail; and an adapter having an adapter body with a predetermined elongate shape, the adapter body including a length extending along a long axis of the adapter body;

wherein one of the first and second rails is detachably connected to the adapter at a junction; and wherein a cross section of the adapter body at the junction is the same as a cross section of the one of the first and second rails to which the adapter is detachably connected at the junction and extending throughout the length of the adapter body and the length of the one of the first and second rails to which the adapter is detachably connected for a constant transition from the adapter to the one of the first and second rails to which the adapter is detachably connected for communicating the appearance of a one-piece part.

* * * * *